United States Patent [19]

Arntyr et al.

[11] 4,419,232

[45] Dec. 6, 1983

[54] FILTERING AND COLLECTING DEVICE FOR WATER DRAINS

[76] Inventors: Oscar S. Arntyr, Wallingatan 37, S-111 24 Stockholm; Thord I. Engström, S-950 18 Bensbyn, both of Sweden

[21] Appl. No.: 319,753

[22] Filed: Nov. 9, 1981

[30] Foreign Application Priority Data

Oct. 1, 1981 [SE] Sweden ..... 8105804

[51] Int. Cl.[3] ..... E03F 1/00

[52] U.S. Cl. ..... 210/164; 404/5; 210/170; 210/323.1; 210/471

[58] Field of Search ..... 210/163, 166, 227, 315, 210/316, 318, 323.1, 470, 471, 445, 489, 164, 165, 170; 404/2–5

[56] References Cited

U.S. PATENT DOCUMENTS

| | | | |
|---|---|---|---|
| 603,323 | 5/1898 | Eckart | 210/489 |
| 1,501,073 | 7/1924 | Stead | 210/489 |
| 2,384,057 | 9/1945 | Wetherell | 210/489 |
| 3,713,539 | 1/1973 | Thompson et al. | 210/164 |
| 3,815,748 | 6/1974 | Johannessen | 404/4 |

*Primary Examiner*—Charles N. Hart
*Assistant Examiner*—Sharon T. Cohen
*Attorney, Agent, or Firm*—Sughrue, Mion, Zinn, Macpeak and Seas

[57] ABSTRACT

A device for use in water drains provided with an outer drain grating for preventing accidents and coarse material falling into the drain. The device is intended for separating and collecting particulate impurities, such as sand, wooden pegs and leaves, and also oil and other liquid impurities passing through the grating. To this end, the device includes a holder ring intended to be mounted under the drain grating, and carrying the combination of a coarse-filtering and protecting means and a fine-filtering means. The coarse-filtering and protecting means is cup-shaped and arranged in the holder ring, while the fine-filtering means comprises a filter bag of a flexible and water-permeable cloth or fabric material arranged around the holder ring. The holder ring is preferably funnel-shaped and provided with a mounting flange arranged to be firmly clamped beneath the drain grating, and the coarse-filtering and protecting means comprises preferably a wire basket.

6 Claims, 3 Drawing Figures

Figure 1:
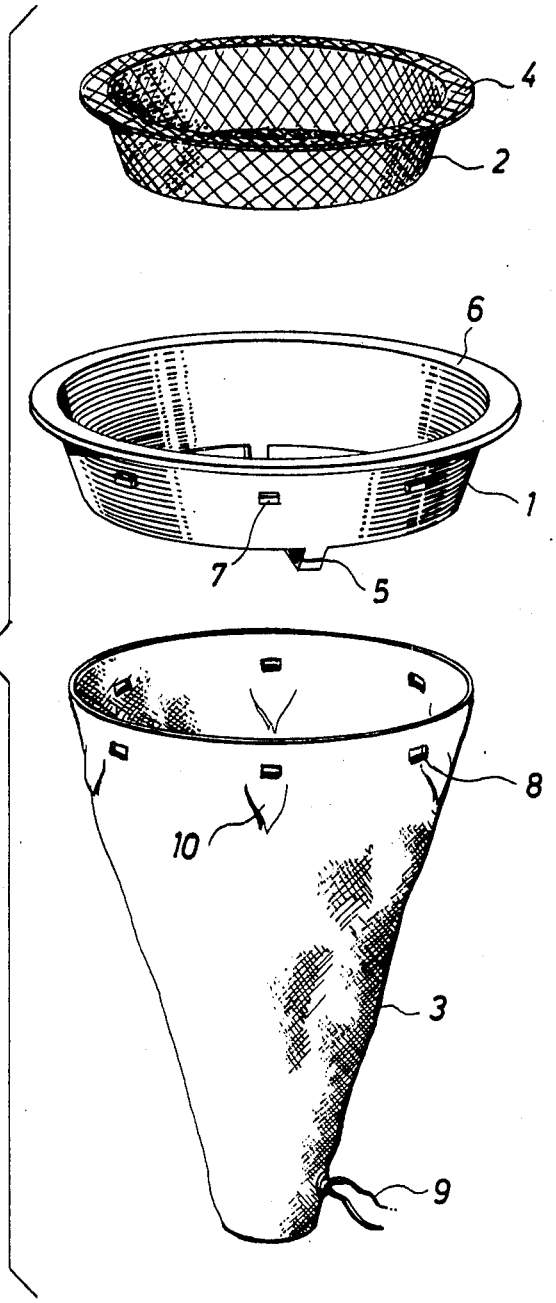

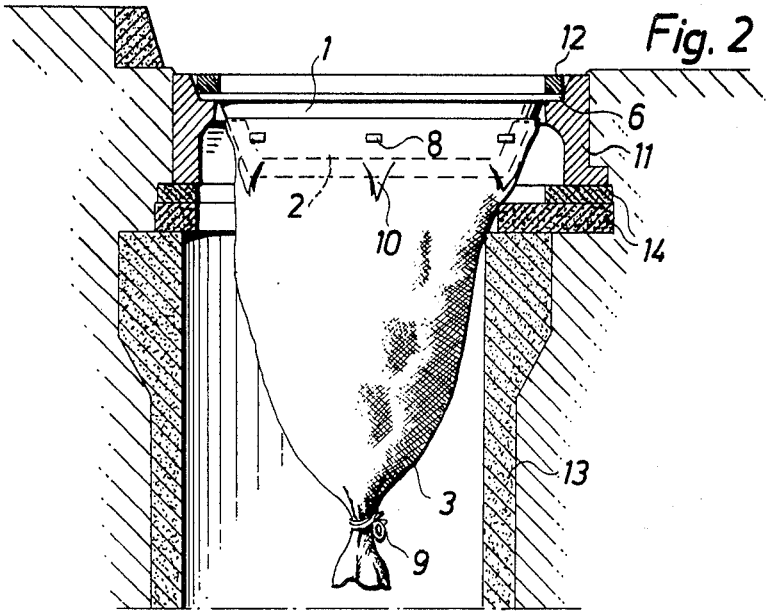
Fig. 2
Fig. 3
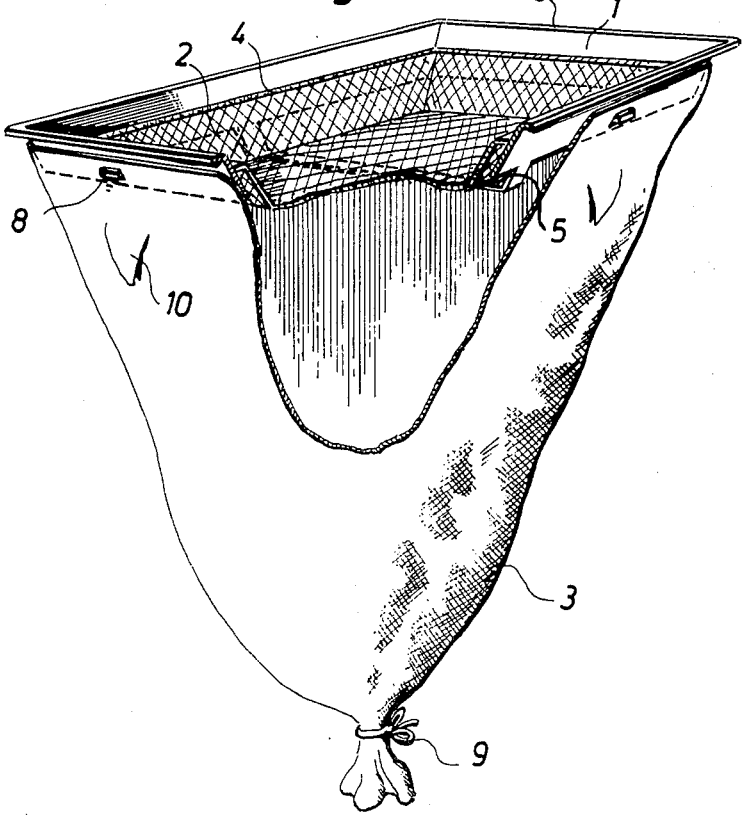

FILTERING AND COLLECTING DEVICE FOR WATER DRAINS

The present invention relates to water drains of the kind provided with an outer drain grating which acts as a drain cover to prevent accidents and as a means for preventing coarse material from passing down into the drain, and more particularly to a device for use in such drains to separate and collect particulate impurities, such as sand, wooden pegs and leaves, and also liquid impurities, such as oil, passing through the grating.

A large number of devices for collecting particulate material falling down into water drains are known to the art. These devices normally comprise a specially designed grating support combined with a collecting vessel, often provided with a waterseal or drain trap. Such devices, however, normally require the drains to be adapted to the system in question from the very beginning. Consequently, it is difficult to provide existing systems with collecting and separating devices without incurring significant costs. A further disadvantage with known filtering and collecting devices of the aforementioned kind is that they cannot readily be used in drains where the grating is offset relative to the lower part of the drain. However, the capacity and/or efficiency of such devices is, or are, at times sadly lacking, the former defficiency resulting in flooding and the latter defficiency enabling contaminants to enter the drains, which contaminants must be flushed away or sucked out at given intervals of time. Neither are the known devices effective in separating oil or other liquid impurities from the drain water passing through the grating. In addition, these known devices are difficult to empty, and the work of emptying the devices is unhygienic. The purchase price of the known devices is often relatively high, as is also the cost incurred when changing the collecting vessels.

The main object of the present invention is to provide a simple and effective separating and collecting device which can be manufactured and mounted in position at low costs and used in drains of widely varying design, thereby eliminating the aforementioned disadvantages. In addition to filtering out particulate material, the device shall also be capable of filtering out oil and other liquid impurities to a certain extent.

The aforementioned objects are achieved in accordance with the invention by providing a device of the aforementioned kind with two separation stages, of which the last stage is a fine-filtering stage utilizing a water-permeable cloth.

The device according to the invention is particularly characterized in that it comprises a holder ring intended to be mounted beneath the drain grating, said holder ring carring a combination of at coarse-filtering and protecting means and a fine-filtering means; that the coarse-filtering and the protecting means is cup shaped and arranged in the holder ring; and that the fine-filtering means comprises a filter bag made of a flexible and water-permeable cloth or fabric material and arranged around the holder ring.

Such a filtering and collecting device is of extremely simple construction, it is also cheap to manufacture and can readily be stored and mounted in position, in addition to which the use of a flexible bag enables the device to be installed in different kinds of known drainage systems, irrespective of whether the grating is centred relative to the remainder of the drain or not. The use of a filtering fabric material also enables the device to be used for separating oil and other viscous liquid impurities from the drainage water.

Since the impurities are separated in two stages when using a device constructed in accordance with the invention, said two stages being additional to the separation of coarse particulate material by the drain grating, it is possible to combine effective separation and collection with an effective through flow of the drainage water. Coarse particles, such as gravel, leaves and the like, are captured in the first separating stage and consequently do not impair the permeability of the relatively fine-mesh filtering bag, which—as beforementioned—can be adapted to permit oil and other liquid impurities to be filtered off. For example, if leaves were permitted to freely enter the bag, the bag would rapidly become blocked. Consequently, it is important when using a filtering bag, the use of which is to great advantage per se, to combine the bag with an effective pre-separating means, which shall also be capable of protecting the bag so as to prevent the same, for example, from being torn by wooden pegs or other sharp contaminants which could otherwise enter the bag.

According to one preferred embodiment of the invention, the holder ring is funnel-shaped and provided with a mounting flange arranged to be clamped firmly under the drain grating, and the filtering bag is suspended from the outer surface of the holder ring. In this embodiment the menas for filtering coarse material and for protecting the bag has the form of a wire basket so constructed as to form a gap between said means and the surrounding holder ring. This enables maximum use of the volumetric capacity of the basket. The height or thickness of the holder ring should be less than half the height of a grating-support means carrying said drain grating, to enable the device according to the invention to be readily mounted also in drains in which said grating-support means is not centred.

In a preferred embodiment of the filtering bag, the bag is openable at its lower end, thereby enabling the bag to be readily emptied on a hygienic manner, and also enabling the bag volume to be adapted to existing requirements. Further, the filtering bag is suitably provided adjacent its upper end with overflow openings, to provide increased flow possibilities when so required, for example in the case of heavy downpours.

Exemplary embodiments ot the invention will now be described in more detail with reference to the accompanying drawings, in which FIG. 1 illustrates schematically the components forming a device according to the invention, FIG. 2 illustrates a device according to the invention mounted in a water drain; and FIG. 3 is a partly cut-away prespective view of a modified embodiment of a device according to the invention.

The device illustrated in FIG. 1 includes a funnel-shaped holder ring 1, which serves finally to hold the coarse-filtering means, said means having the form of a wire basket 2 which can be inserted in the holder ring, and secondly to hold the fine-filtering means, which has the form of a filtering bag 3 made of a flexible fabric or cloth material and capable of being mounted on the outer surface of the ring 1. As beforementioned, the wire basket 2 is intended to be inserted into the holder ring 1, whereat a flange 4 on the basket 2 co-acts with the inner converging surface of the holder ring 1 and firmly clamps the basket while leaving an anular gap between said basket and the inner surface of the ring 1. This gap enables the permeability of the basket to be retained until it is completely filled with material. The holder ring 1 is provided with a transverse handle 5, which also serves to prevent the wire basket from being pressed down into the drain.

For mounting purposes the holder ring is provided with a mounting flange 6, which is intended to be firmly pressed against the grating-support means beneath the external drain grating. The holder ring is provided on its outer surface with mounting means 7, on which the bag 3 can be mounted, said bag also being funnel-shaped. Thus, the holder ring can extend as a funnel down into the filtering bag 3. The suspension means 7 may, for example, have the form of hooks or through-passing holes for receiving attachment means, said attachment means being passed through holes 8 arranged around the upper end of the bag 3.

The filter bag 3 is suitably made of a water-permeable, relatively fine-mesh filter cloth of glass or plastics fibre, for example a polyester fabric. The sack is made in the form of a truncated cone which is open at both ends thereof, and is provided at its lower, narrow end with tapes 9 or the like by which said end can be closed. Arranged at the upper end of the bag is a number of slot-like overflow openings 10, which increase the through-flow capacity of the bag when required, for example in the case of heavy downpours. The tapes 9 also enable the volumetric capacity of the bag to be adjusted in dependence upon existing requirements, and also enable the bag to be emptied in a hygienic fashion without requiring the bag to be turned upside down. In this regard, the bag is simply lifted by the handle 5 and the tapes 9 loosened, whereupon the contents of the bag will fall into a container intended therefor.

As beforementioned, the combination of wire basket and filter bag is greatly advantagous, since in this way it is possible to combine effective separation of contaminating materials, including liquid impurities such as oil and the like, with an effective through-flow of the drainage water. The wire basket 2, however, does not only serve as a coarse-filtering means, but also to protect the bag from intentional or unintentional damage, e.g. by means of sticks inserted into the drain through the grating.

FIG. 2 illustrates schematically the manner in which the device according to the invention is mounted in a water drain. Reference numeral 11 identifies the grating-support means which carries a drain grating 12, under which the mounting flange 6 of the holder ring 1 is firmly pressed. In the illustrated embodiment, the grating-support means 11 rests on a number of adjustment rings 14 and is not centered relative to the lower part 13 of the drain. Such lateral displacement of the grating-support means is quite common, for example in drains located in street gutters, and can in practice be much greater than that illustrated in the drawing. With drains of this kind it is necessary for the collecting means to have the form of a flexible bag, since otherwise a means of special design must be manufactured. To enable a device according to the invention to be installed in drains irrespective of the magnitude by which the grating-support means is displaced relative to the bottom portion of the drain, the height or thickness of the holder ring 1 shall be smaller than the height or depth of the grating-support means 11, and preferably not more than about half the height or depth of said grating-support means.

FIG. 3 illustrates a device according to the invention for use in a drain in which the grating is accomodated in a rectangular opening. The device, however, has the same design as the device illustrated in FIGS. 1 and 2, and hence no additional description of this embodiment is required. The references used in FIG. 3 identify the same elements as the references previously used.

The device according to the invention thus comprises only three parts, which can be manufactured at low costs. By using a flexible bag, the devices requires the minimum of space for storing and transporting the same. That part of the device which is subjected to the most wear is the bag, which can be replaced with a new bag at relatively low cost when necessary. The use of a bag according to the invention also prevents water from collecting, such water collections being prone to freeze in cold weather and generating unpleasant odours in dry periods. By providing the bag and the holder ring with uniformly spaced attachment means, the bag can be mounted in any position of rotation whatsoever. A bag also provides a very large filtering area, which can be adjusted as required.

A device according to the invention can be modified in several respects within the scope of the claims. Thus, its geometric shape can be adjusted to the drain in which it is to be mounted. The coarse-filtering means may, in addition to a wire basket, also comprise another cup-shaped container having good permeability. As essential feature of the device according to the invention, however, is that it comprises two separating stages, of which the last stage includes a flexible cloth of fabric material to provide a fine filtering effect, while the first stage serves to separate coarse material from the drainage water and to protect the bag.

What is claimed is:

1. A filter device for an outdoor water drain in a paved roadway gutter or the like, said drain having an outer protective grating 12 for preventing vehicles, pedestrians and large objects from falling therethrough, said filter device serving to separate and collect particulate impurities such as sand, twigs and leaves, and also oil and other liquid impurities passing through the grating, and comprising:

a continuous holder member (1) adapted to be mounted beneath the drain grating, said holder member having downwardly depending, fluid impervious sides, a relatively rigid and shallow coarse-filtering wire basket (2) removably disposed within said holder member and having downwardly depending sides, and a fine-filtering bag (3) made of a flexible and water-permeable cloth or fabric material removably disposed around the outside of said holder member and depending downwardly beyond the sides thereof and substantially below said wire basket, whereby said bag may be shifted laterally away from a vertical axis of the filter device below the holder member to accommodate for irregularities in the drain structure, said holder member including support means (5) extending inwardly from lower edges of its sides for supporting the wire basket, and said support means also serving as a handle by which the holder member and bag may be lifted together to facilitate emptying the bag.

2. A device according to claim 1, wherein the holder member is funnel-shaped and provided with a mounting flange arranged to be firmly clamped beneath the drain grating; and the filter bag is suspended from the outer surface of the holder member.

3. A device according to claim 1, wherein the wire basket is so constructed that it forms a gap between said basket and the surrounding holder member.

4. A device according to claim 1, wherein the height of the holder member is less than the height of a grating-support means carrying said drain grating, preferably less than half the height of said grating support.

5. A device according to claim 1, wherein the filter bag is openable at its lower end.

6. A device according to claim 1, wherein the filter bag is provided at its upper end with overflow openings.

* * * * *